US007306491B1

(12) United States Patent
Wei

(10) Patent No.: US 7,306,491 B1
(45) Date of Patent: Dec. 11, 2007

(54) CHIP CARD RETAINING MECHANISM AND ELECTRONIC DEVICE THEREWITH

(75) Inventor: Xiao-Liang Wei, Shenzhen (CN)

(73) Assignees: ShenZhen FuTaiHong Precision Industry Co., Ltd., Shenzhen, Guangdong Province (CN); Sutech Trading Limited, Tortola (VG)

( * ) Notice: Subject to any disclaimer, the term of this patent is extended or adjusted under 35 U.S.C. 154(b) by 0 days.

(21) Appl. No.: 11/695,420

(22) Filed: Apr. 2, 2007

(30) Foreign Application Priority Data

Aug. 11, 2006 (CN) ..... 200610062068

(51) Int. Cl.
*H01R 24/00* (2006.01)

(52) U.S. Cl. ..... 439/630; 439/928.1; 235/441

(58) Field of Classification Search ..... 439/630, 439/326, 928.1, 328, 64; 235/441
See application file for complete search history.

(56) References Cited

U.S. PATENT DOCUMENTS 6,969,282 B2 * 11/2005 Liu ..... 439/630

* cited by examiner

*Primary Examiner*—Javaid H. Nasri
(74) *Attorney, Agent, or Firm*—Jeffrey T. Knapp

(57) ABSTRACT

A chip card retaining mechanism (200) used in an electronic device (100) includes a sliding seat (20) and a sliding member (30). The sliding seat includes a main body (22) and two vertical portions (242) extending, respectively, from two opposite sizes of the main body. Each vertical portion defines a guide slot (26). The main body defines an opening (222) for receiving a connector (104) of the electronic device. The sliding member includes a stopping portion (36) and a receiving groove (35) for receiving a chip card (102). The stopping portion is positioned on one end of the sliding member. A shaft (39) is mounted on another end of the sliding member, and the two respective ends thereof are inserted into a corresponding guide slot so that the sliding member is slidably attached to the sliding seat.

20 Claims, 13 Drawing Sheets

CHIP CARD RETAINING MECHANISM AND ELECTRONIC DEVICE THEREWITH

BACKGROUND OF THE INVENTION

1. Field of the Invention

The present invention relates to chip card retaining mechanisms and, particularly, to a chip card retaining mechanism for seating a chip card and an electronic device therewith.

2. Description of Related Art

Many electronic devices utilize a chip card. For example, a SIM (subscriber identification module) card is customarily used for storing information necessary for operating a mobile phone or other portable electronic device. This kind of chip card may further contain personal information for a subscriber of a mobile phone network. For example, the chip card may store a list of frequently used telephone numbers.

It is generally necessary to provide a chip card retaining mechanism in an electronic device to hold the chip card in place. Generally, the chip card retaining mechanism typically has one of two settings: one is under the battery of the electronic device and another is parallel with the battery. However, the thickness of the electric device might be increased if the chip card retaining mechanism is set under the battery. Therefore, it is best usually for the chip card retaining mechanism used in the electronic device to be set parallel with the battery, so as to satisfy the requirements of miniaturization of the electronic device.

Referring to FIGS. 12-13, a typical chip card retaining mechanism 62, parallel with a battery (not shown), is used in a rear portion of an electronic device 300 for receiving a chip card 63. The chip card retaining mechanism 62 is set in a housing 64. The chip card retaining mechanism 62 includes a low-profile receiving portion 622, two opposite wings 624, and an elastic stopper 625. The receiving portion 622 is defined by two strips 626 protruding from a main surface 642 of the housing 64 and is shaped to receive the chip card 63. The two strips 626 define two openings 627, 628. The elastic stopper 625 is located under the middle portion of the opening 628. The wings 624 extend from the two strips 626 toward each other and overlie the receiving portion 622. A connector 66 is exposed through a bottom of the receiving portion 622.

In use, the elastic stopper 625 is pressed down by the chip card 63, while the chip card 63 is slid into the receiving portion 622, via the opening 628. Then, when the card 63 is fully inserted in the receiving portion 622, the elastic stopper 625 is released and returns to its original position. Thus, the chip card 63 is locked in the receiving portion 622 by the wings 624, the strips 626, and the stopper 625.

The chip card retaining mechanism 62 is exposed to the outside (i.e., ambient environment) during assembly or disassembly of the chip card 63 within/from (as the case may be) the housing 64. Therefore, the appearance of the electronic device may be affected. In addition, during insertion and/or removal of the chip card 63, friction is produced between the chip card 63 and the connector 66. Thus, after repeated use, the contact terminals of the chip card 63 and the connector 66 are likely to suffer from wear and tear. This wear may result, e.g., in an ineffective electrical connection between the chip card 63 and the connector 66. Furthermore, the wings 624 abut a peripheral portion of the chip card 63 and may, for example, cause deformation of the chip card 63. Such a deformation may also result in an ineffective electrical connection.

Therefore, a new chip card retaining mechanism is desired in order to overcome the above-described problems.

SUMMARY OF THE INVENTION

In one embodiment thereof, a chip card retaining mechanism, used in a portable electronic device, includes a sliding seat and a sliding member. The sliding seat includes a main body and two vertical portions extending from two opposite sizes of the main body. Each vertical portion defines a guide slot. The main body defines an opening configured (i.e., structured and arranged) for receiving a connector of the electronic device. The sliding member includes a stopping portion and a receiving groove configured for receiving a chip card of the electronic device. The stopping portion is positioned on one end of the sliding member. A shaft is mounted on another end of the sliding member. The two ends of the shaft are inserted into a corresponding guide slot of the sliding seat so that the sliding member is slidably attached to the sliding seat.

Other advantages and novel features will become more apparent from the following detailed description when taken in conjunction with the accompanying drawings.

BRIEF DESCRIPTION OF THE DRAWINGS

Many aspects of the chip card retaining mechanism can be better understood with reference to the following drawings. The components in the drawings are not necessarily drawn to scale, the emphasis instead being placed upon clearly illustrating the principles of the present chip card retaining mechanism. Moreover, in the drawings, like reference numerals designate corresponding parts throughout the several views.

DETAILED DESCRIPTION OF THE INVENTION

An exemplary chip card retaining mechanism is configured for retaining a chip card in an electronic device in a manner such that the chip card is electrically connected with a connector in the electronic device.

Figure 1:
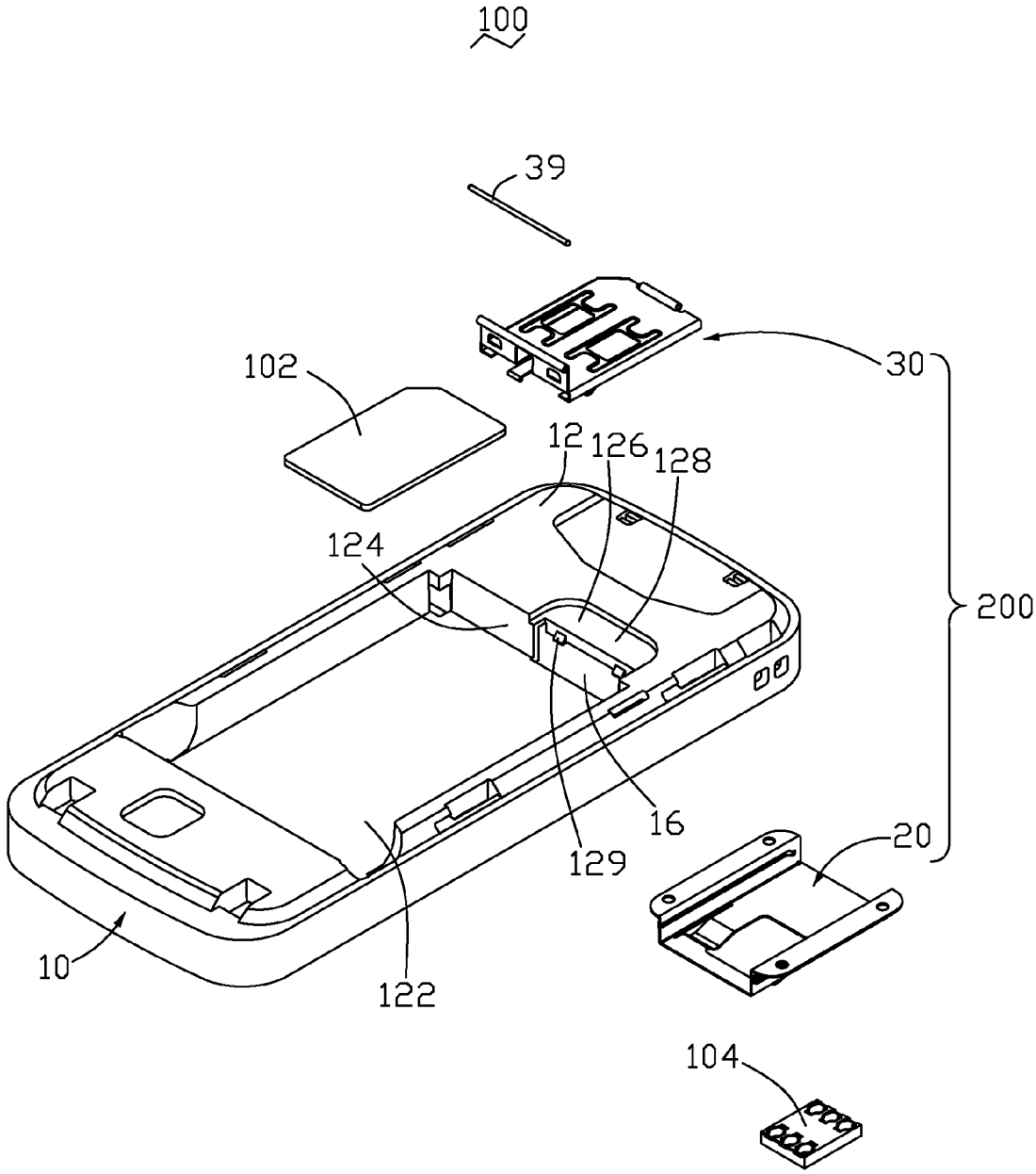
FIG. 1 is an exploded, isometric view of a portable electronic device, incorporating a chip card retaining mechanism, in accordance with a preferred embodiment.

Referring to FIG. 1, a chip card retaining mechanism 200 is shown as provided in an electronic device 100, such as a mobile phone or PDA, according to a first preferred embodiment. In order to identify a user of the electronic device 100 during use, a chip card 102, such as a subscriber identification module (also called a SIM card), is provided. When the chip card 102 is engaged in the chip card retaining mechanism 200, the chip card 102 is electrically connected to a printed circuit board (PCB, not shown) of the electronic device 100 by a connector 104.

Figure 2:
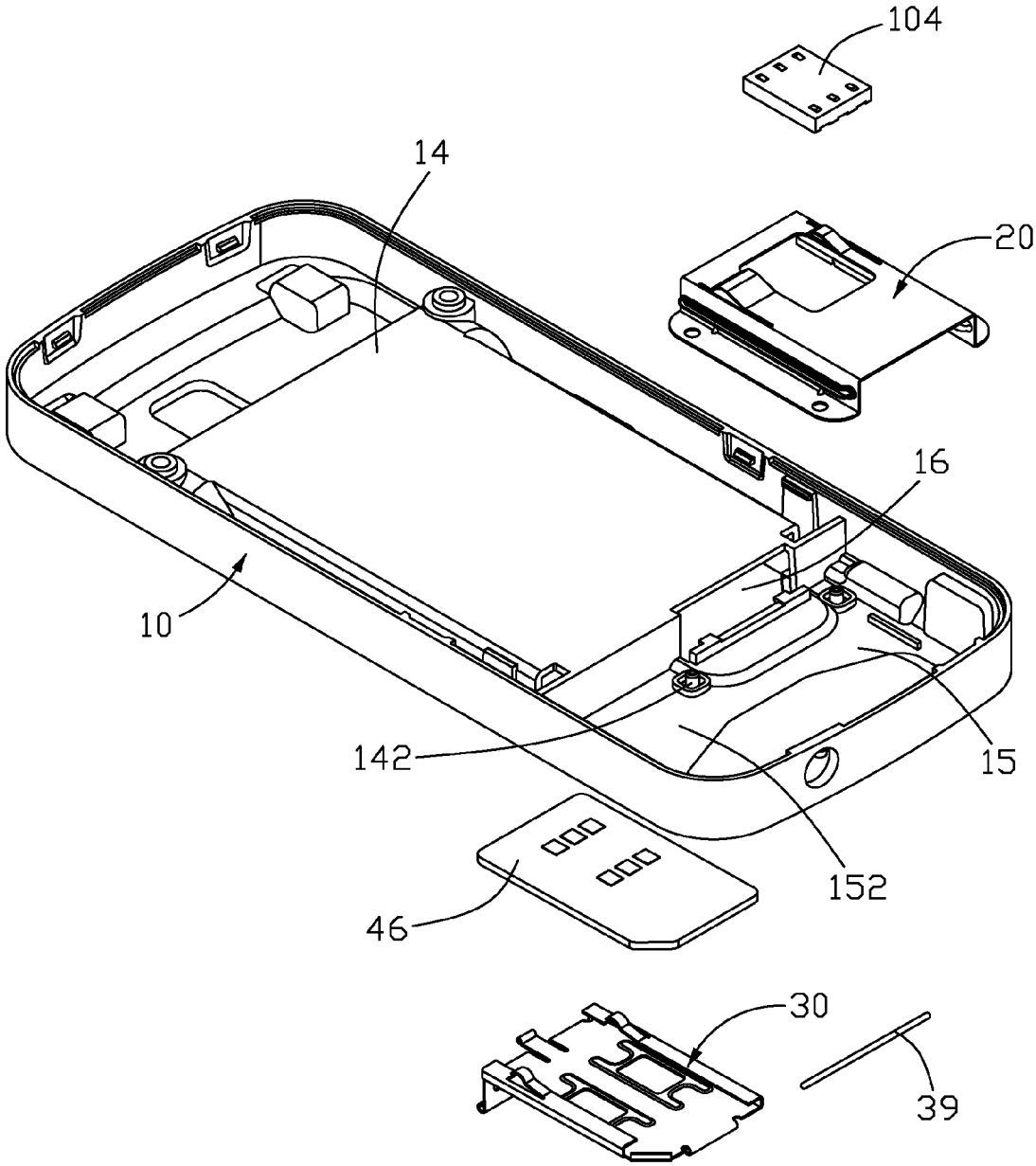
FIG. 2 is similar to FIG. 1, but showing another aspect.

Also, referring to FIG. 2, the electronic device 100 includes a housing 10. The housing 10 has an upper surface 12 and a lower surface 14. A battery compartment 122 is defined in the upper surface 12 adjacently to a sidewall 124. The battery compartment 122 is configured for receiving a battery (not shown). The lower surface 14 has a receiving cavity 15 defined beside the sidewall 124. A rectangular through hole 16 is defined in the sidewall 124, so as to allow the battery compartment 122 to communicate with the receiving cavity 15. A plate 126 is formed above the through hole 16. The plate 126 has a top surface 128 recessed from the upper surface 12 of the housing 10, such a recessed portion being configured for receiving a finger of a user to ease movement thereof. Two spaced triangle-shaped locking blocks 129 are formed on the plate 126 and extend toward the battery compartment 122. Four positioning posts 142 are formed on a bottom surface 152 of the receiving cavity 15, which are used to fasten the chip card retaining mechanism 200 in place within the housing 10. The chip card retaining mechanism 200 includes a sliding seat 20 and a sliding member 30. The sliding seat 20 may, advantageously, be made of a metal.

Figure 3:
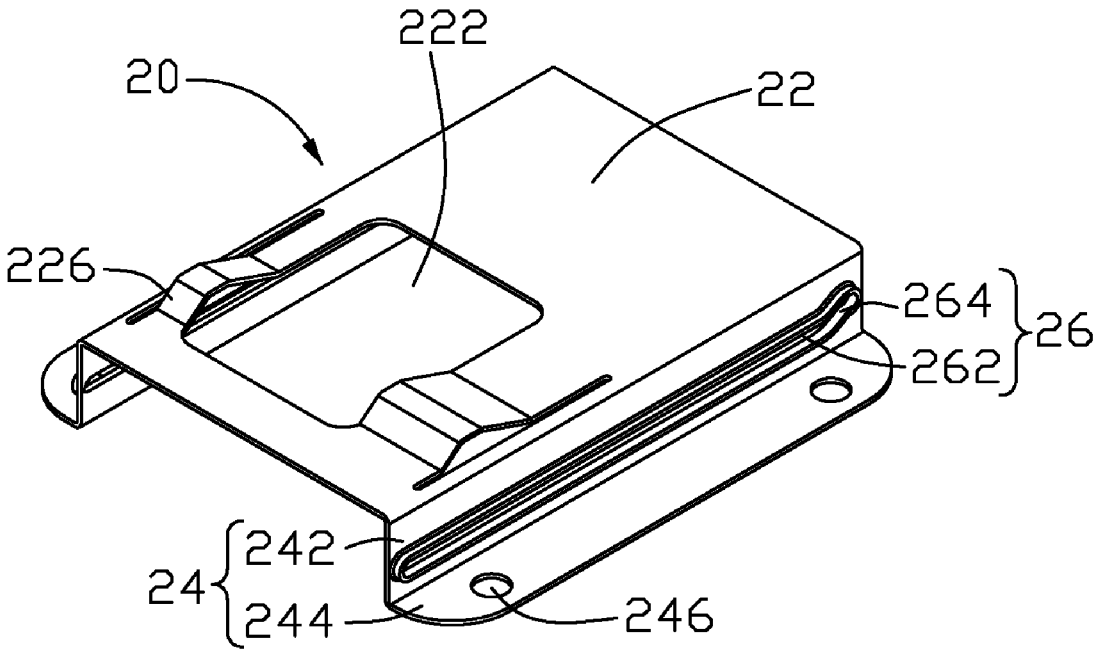
FIG. 3 is an isometric view of a sliding seat shown in FIG. 1.
Figure 4:
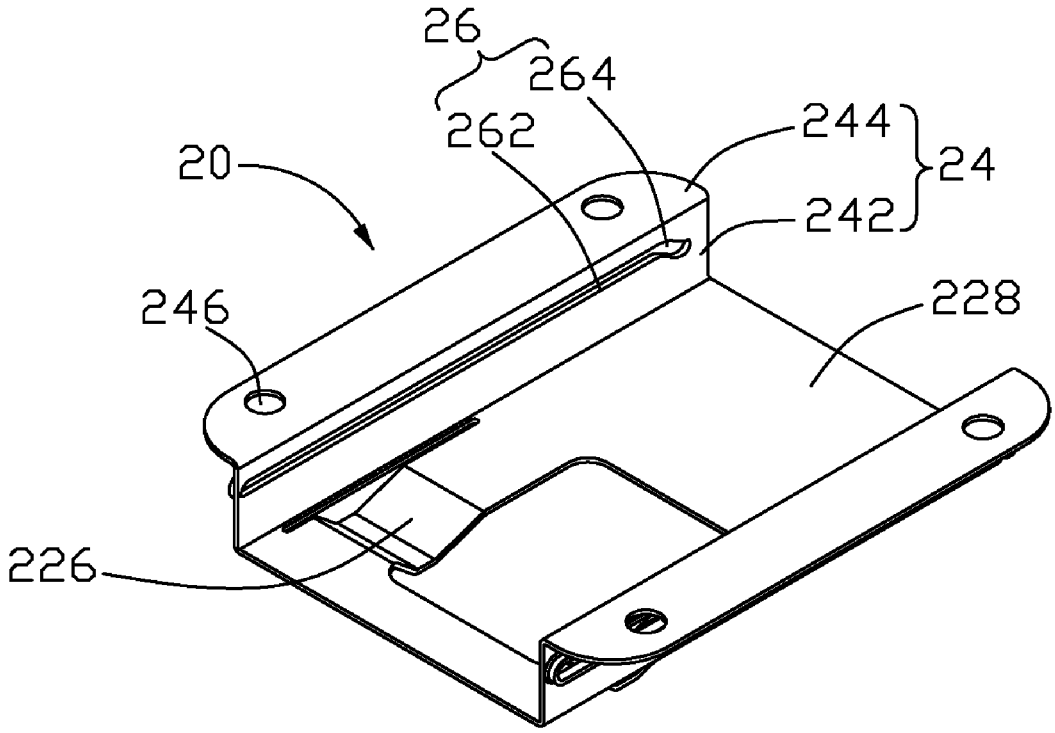
FIG. 4 is similar to FIG. 3, but showing another aspect.

Referring to FIGS. 3-4, the sliding seat 20 includes a main body 22 and two L-shaped locking plates 24 integrally formed with the main body 22. The main body 22 is approximately rectangular and has a rectangular opening 222 defined in one end thereof, the rectangular opening 222 being configured for receiving the connector 104. Two receiver portions 226 (in the form of deformed strips) are respectively formed next to the opening 222 and opposite to each other and are each configured to act as a receiving member, in a manner that ultimately limits sliding of the sliding seat 20 relative the sliding member 30 (the manner of such to be described later). The respective receiver portions 226 each are recessed from one surface 228 of the main body 22 so as to form a nearly V-shaped (as illustrated by way of example) receiving well extending directly from the one surface 228. The one surface 228 and a corresponding receiver portion 226 together define a respective a near-V gap (as illustrated, possibly best described as a truncated V-shape). It is to be understood that another angled (e.g., V or U) or arcuate shape could potentially be employed for the respective receiver portions 226. It is advantageous for the two receiver portions 226 to have a similar cross-sectional shape to promote an even sliding movement of an opposed element relative to the main body 22.

The two locking plates 24 are perpendicular and extend directly from two opposite sides of the main body 22, respectively. The locking plate 24 includes a rectangular vertical portion 242 connected with the main body 22 and a rectangular horizontal portion 244 perpendicularly extending directly from the vertical portion 242. The extending directions of the two respective horizontal portions 244 are opposite to each other. Each vertical portion 242 has a guide slot 26 defined along a longitudinal direction thereof. The guide slot 26 includes a straight section 262 and a curve section 264. The straight section 262 begins from one end of the vertical portion 242 and, advantageously, extends gradually toward the main body 22 at a low acute angle (e.g., about 5°-30°). It is to be understood, however, that the straight section 262 could be parallel with the main body 22, with all movement of the sliding member 30 toward the main body 22 being made via sliding movement within the curve section 264. Whether parallel or at a low acute angle thereto, each straight section 262 extends in a non-intersecting manner relative to the main body 22. The beginning of the straight section 262 is near the receiver portion 226. The curve section 264 begins from the end of the straight section 262, which is distal from the receiver portion 226, and extends toward (though not reaching) the main body 22, at a distinctly greater slope than the straight section 262. The horizontal portion 244 is parallel with the main body 22 and has two respective positioning holes 246 defined in two opposite end portions thereof. The positioning holes 246 are configured for receiving a corresponding positioning post 142 of the housing 10, so that the sliding seat 20 can be fastened to the housing 10.

Figure 5:
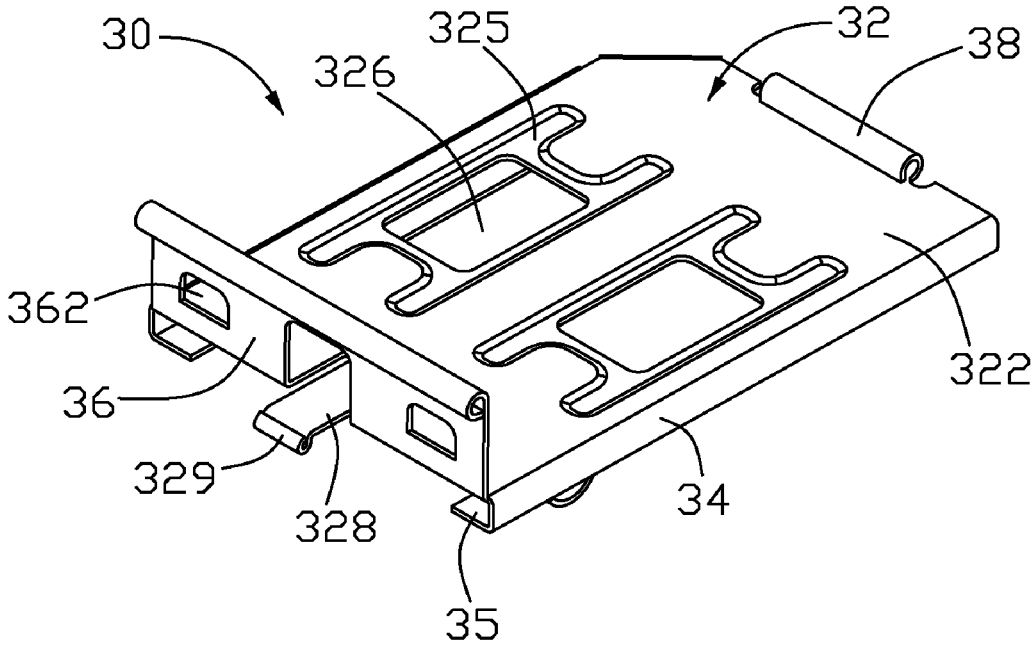
FIG. 5 is an isometric view of a sliding member shown in FIG. 1.
Figure 6:
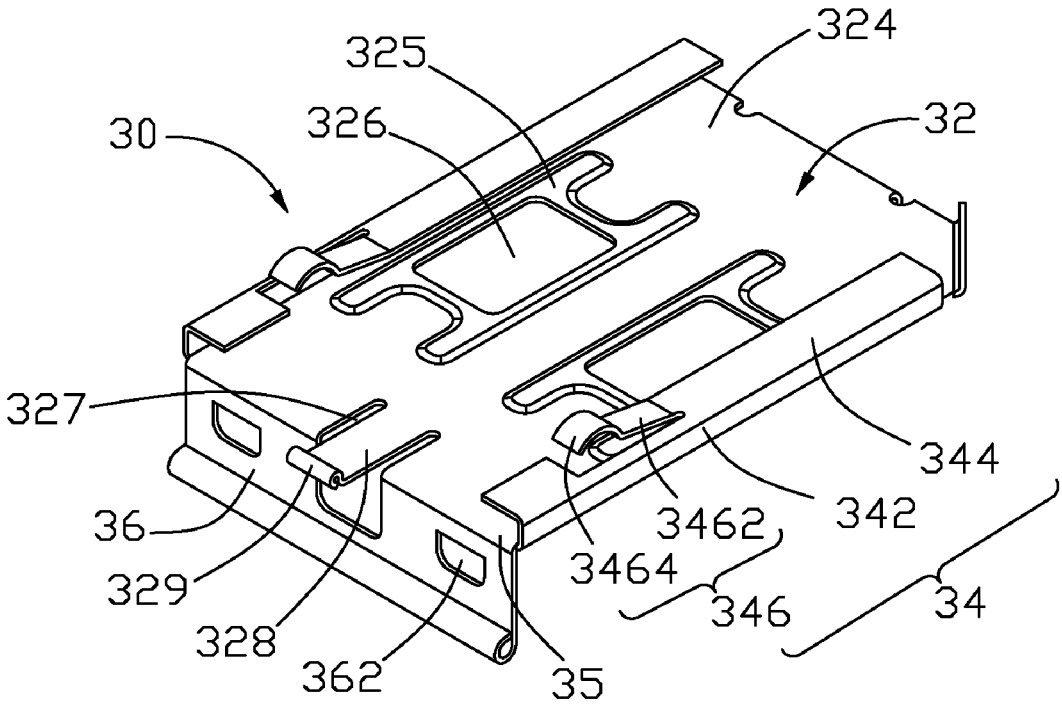
FIG. 6 is similar to FIG. 5, but showing another aspect.

Referring to FIGS. 5-6, the sliding member 30 may, advantageously, be made of a metal. The sliding member 30 includes a main board/substrate 32, two holding portions 34, and a stopping portion 36. The holding portions 34 and the stopping portion 36 are integrally formed with the main board 32.

The main board 32 includes a first surface 322 and a second surface 324, opposite to the first surface 322. Two H-shaped resisting portions 325 are formed on a middle portion of the main board 32. The resisting portions 325 are recessed from the first surface 322 and protrude from the second surface 324. The resisting portions 325 are configured for resisting against the chip card 102. The fact that the resisting portions 325 protrude in such a limited manner effectively reduces the connecting area between the chip card 102 and the main board 32 (i.e., reducing opportunity for friction therebetween). A hole 326 is defined in a center of the resisting portion 325, thereby further reducing the potential connecting area between the chip card 102 and the main board 32 and thus reducing the opportunity for friction therebetween. The main board 32 has two parallel grooves 327 extending to one end thereof so as to form a latching portion 328. The free end of the latching portion 328 is bent to form a barrel 329 above the second surface 324, the barrel 329 being configured for locking the chip card 102 in place. The main board 32 has a hollow fixing portion 38 on the other end along a transverse direction thereof. The fixing portion 38 is bent to be barrel-shaped. A shaft 39 (shown in FIG. 7) is inserted into the fixing portion 38 and mounted in the fixing portion 38, in contact therewith, by solder or other means.

The holding portions 34 are approximately L-shaped and perpendicularly extend, respectively, directly from two opposite sides of the main board 32. Each holding portion 34 includes a vertical plate 342, a horizontal plate 344, and an elastic plate 346. The two horizontal plates 344 perpendicularly extend from a corresponding vertical plate 342. The two horizontal plates 344 are parallel/horizontal to the main board 32 and are directed inwardly toward each other, from their respective side of the main board 32. A receiving space 35 is formed between the main body 22, the two vertical plates 342, and the two horizontal plates 344. The receiving space 35 is configured for slidably receiving and retaining the chip card 102. The elastic plate 346 is formed on one end of the horizontal plate 344, close to the latching portion 328 of the main board 32. The elastic plate 346 includes an unbent section 3462 and a vaulted/arcuate section 3464. Each respective unbent section 3462 flexibly connects with the horizontal plate 344 corresponding thereto and is essentially cantilevered directly therefrom. The vaulted section 3464 is configured for being received in the receiving groove 35 of the sliding seat 20.

The stopping portion 36 perpendicularly extends from the end of the main board 32, close to the latching portion 328. The extending direction of the stopping portion 36 is opposite to that of the vertical plate 342 of the holding portion 34. Two latching holes 362 are, respectively, defined in the two sides of the stopping portion 36, each being configured for receiving one corresponding locking block 129. A free end of the stopping portion 36 is bent to form a barrel.

Figure 7:
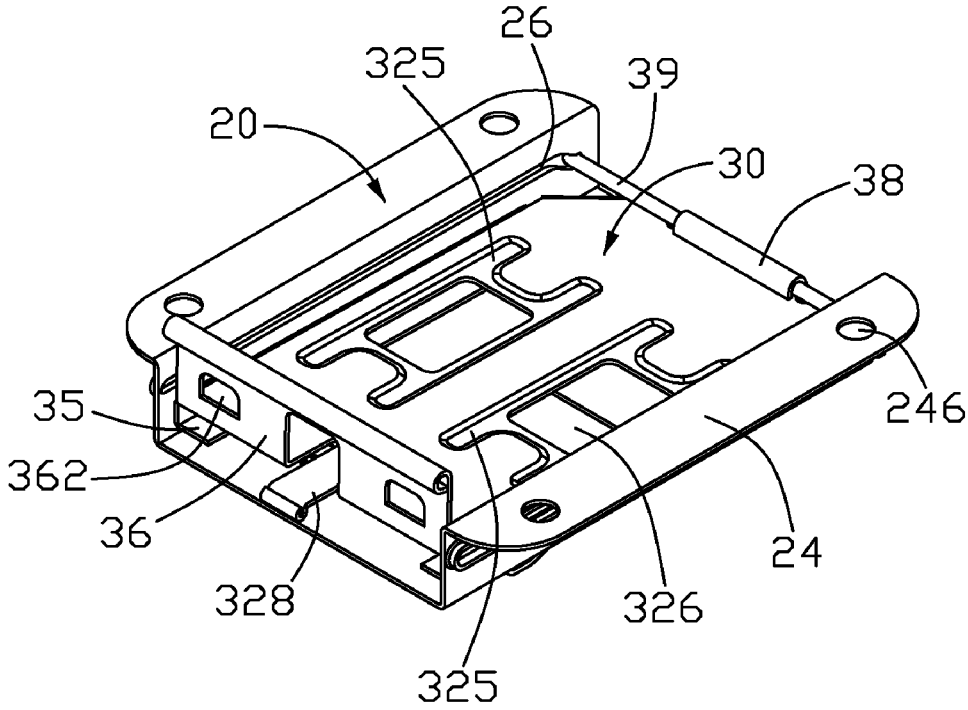
FIG. 7 is an isometric, assembled view of the sliding member and the sliding seat shown in FIG. 1.

Referring to FIG. 7, in assembly of the sliding member 30 to the sliding seat 20, the two locking plates 24 are pushed outward, and the two ends of the shaft 39 are inserted into the corresponding guide slots 26, respectively, with the holding portions 34 facing the main body 22 of the sliding seat 20. When the pressure applied on the locking plate 24 is released, the locking plate 24 returns to its original position, so that the sliding member 30 is thereby attached to the sliding seat 20 by means of the shaft 39. Therefore, the sliding member 30 can slide along the guide slots 26 by means of the engagement of the shaft 39 and the guide slots 26.

Figure 8:
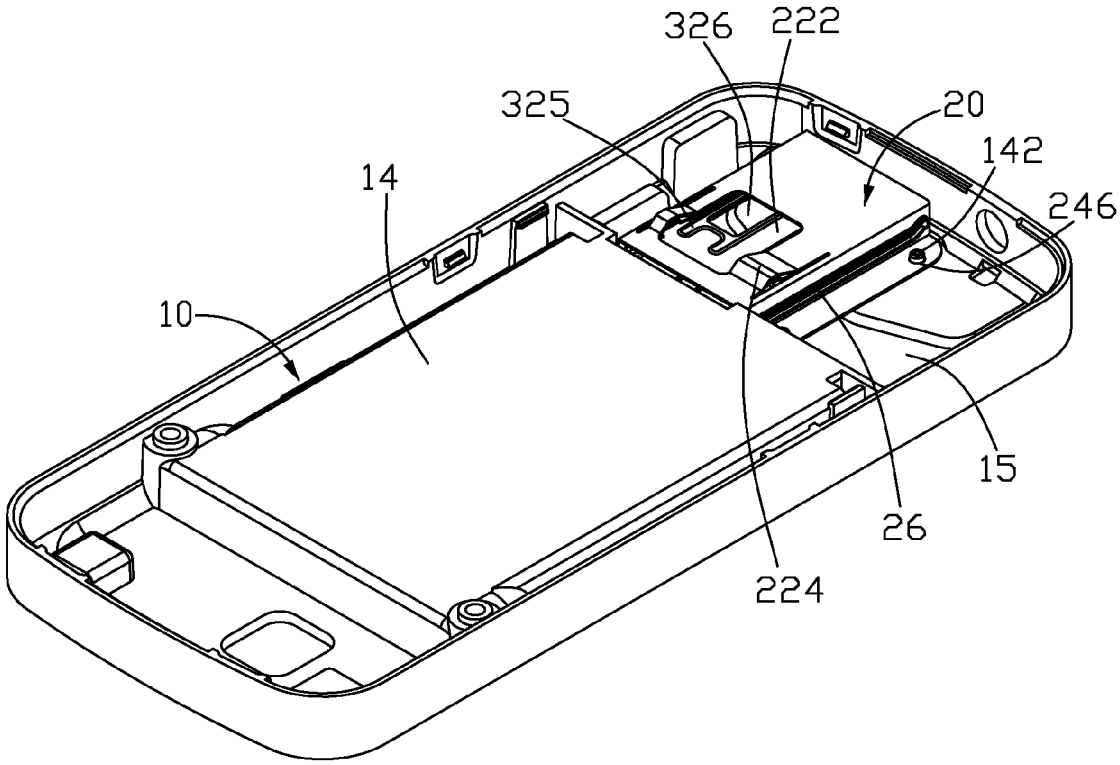
FIG. 8 is an isometric, assembled view of the chip card retaining mechanism and a housing shown in FIG. 1.
Figure 9:
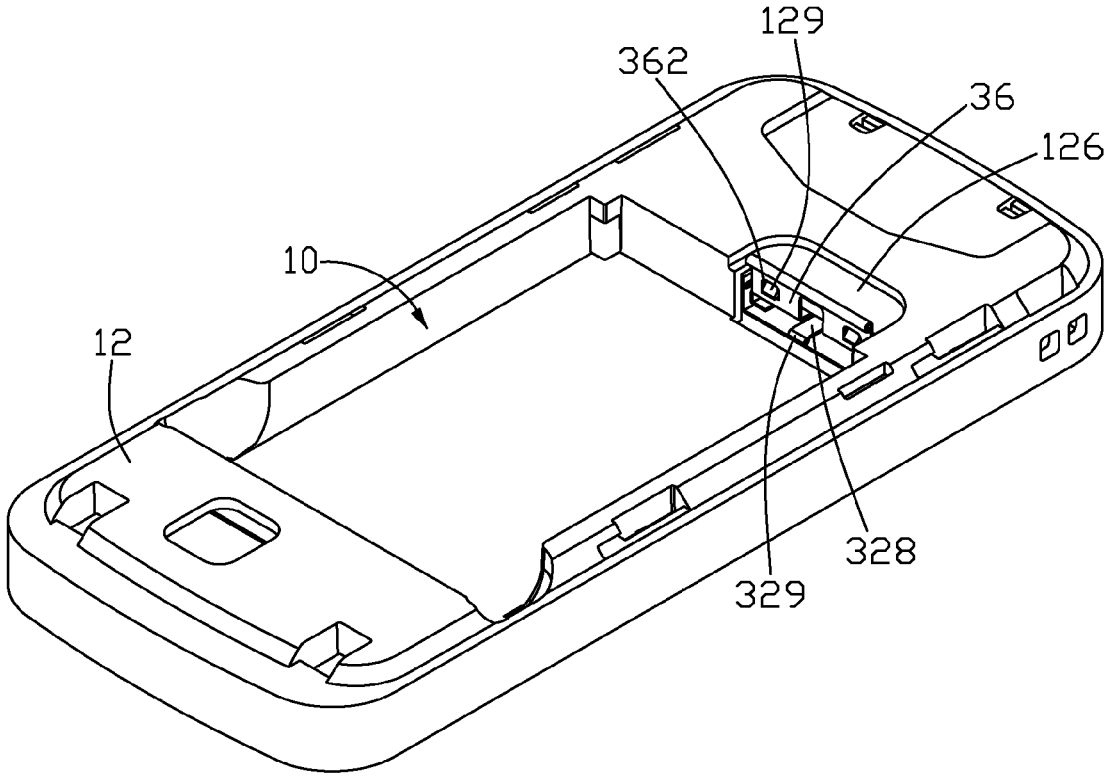
FIG. 9 is similar to FIG. 8, but showing another aspect.

Referring to FIGS. 8-9, in assembly of the chip card retaining mechanism 200 to the housing 10, firstly, the shaft 39 slides into the curve section 264 of the guide slot 26. Secondly, the chip card retaining mechanism 200 is placed above the receiving cavity 15 of the housing 10, with the holding portion 34 of the sliding member 30 facing the bottom surface of the receiving cavity 15. Thirdly, the positioning posts 142 are aligned with the positioning holes 246, and the holding portion 34 is positioned next to the through hole 16 of the housing 10. Fourthly, the holding portion 34 is pushed into the through hole 16 from the receiving cavity 15 and drawn out from the battery compartment 122. When the pressure applied on the holding portion 34 is released, the holding portion 34 rebounds to its original shape. Finally, the holding portion 34 is pushed upwardly until the locking blocks 129 are respectively engaged in the latching holes 362.

Figure 10:
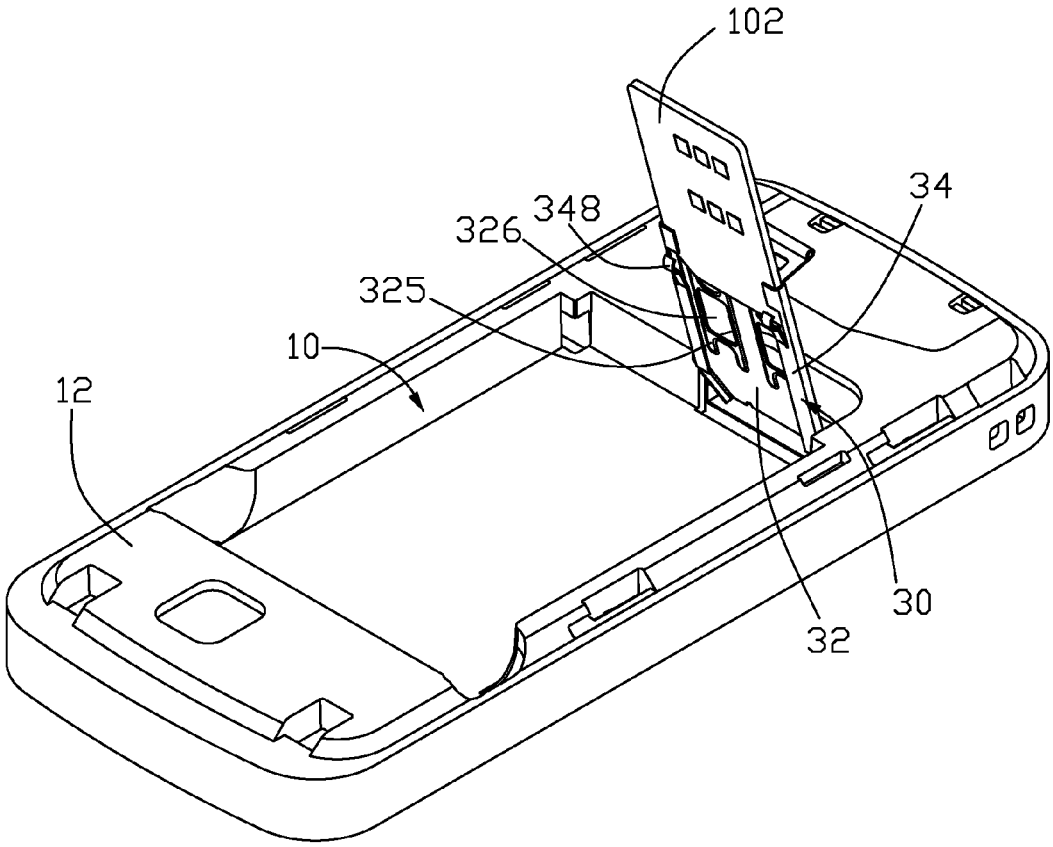
FIG. 10 is similar to FIG. 9, but showing the sliding member pushed out and a chip card being inserted in the sliding member.
Figure 11:
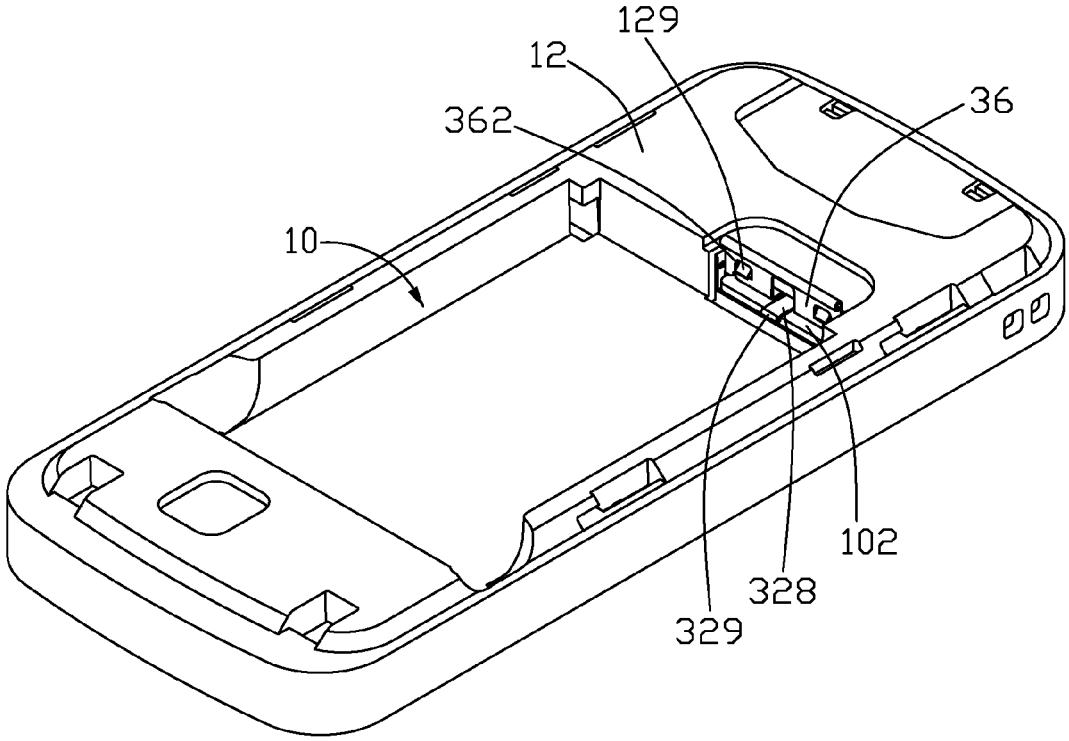
FIG. 11 is similar to FIG. 9, but showing the chip card mounted on/in the chip card retaining mechanism.
Figure 12:
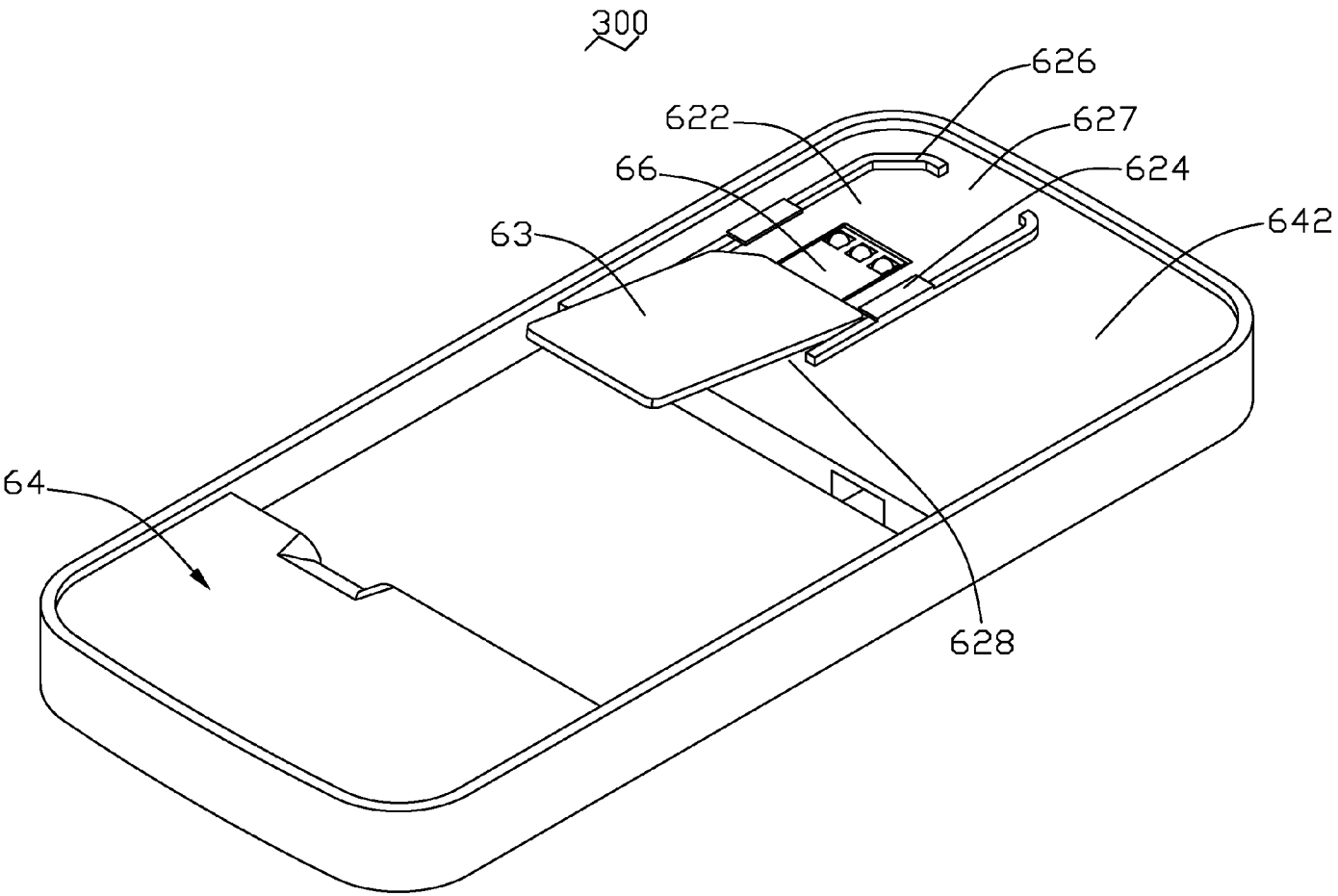
FIG. 12 (RELATED ART)
FIG. 12 is an isometric view of a portable electronic device, incorporating a conventional chip card retaining mechanism, showing a chip card being pushed into the chip card retaining mechanism.
Figure 13:
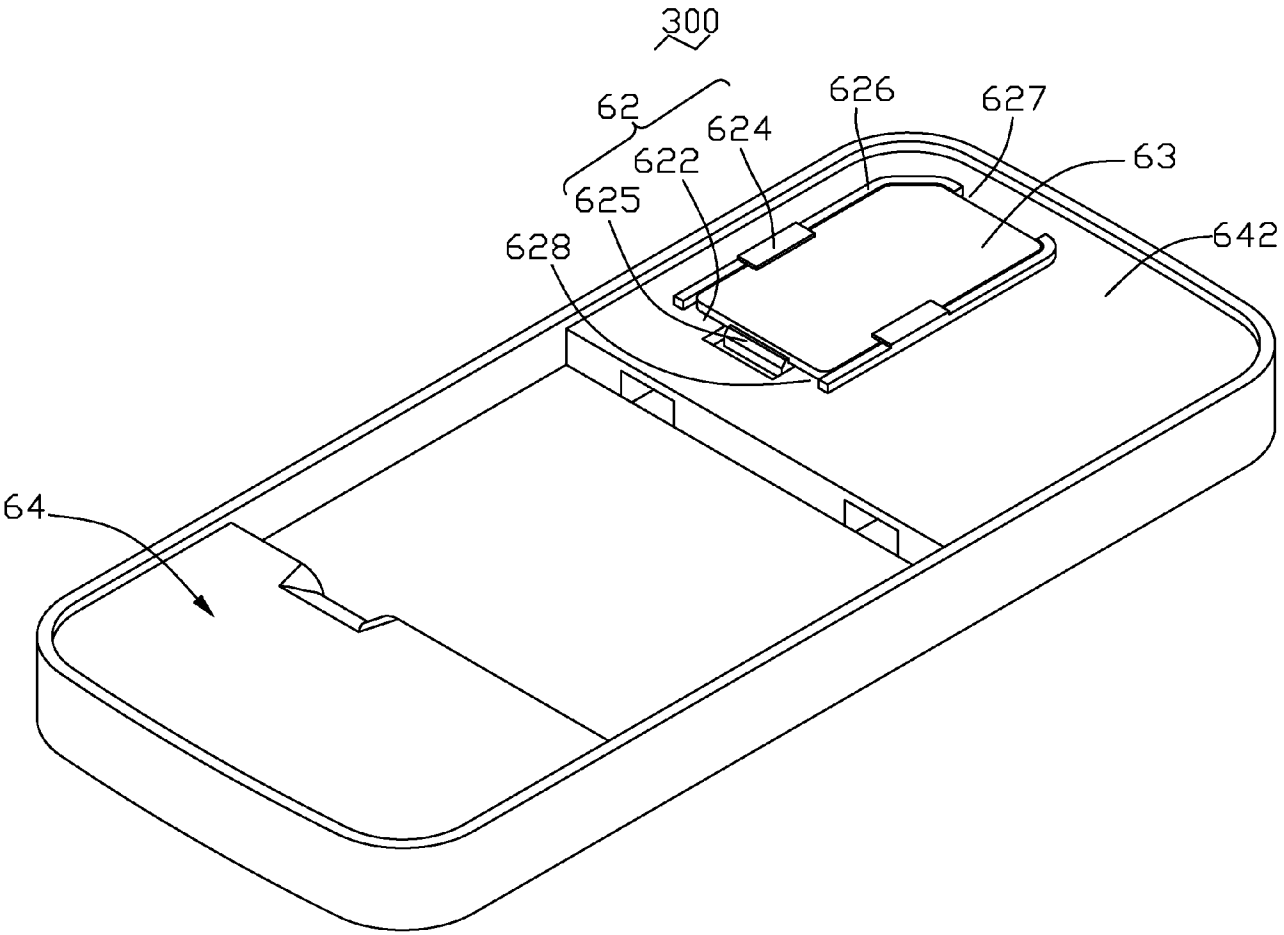
FIG. 13 (RELATED ART)
FIG. 13 is similar to FIG. 12, but showing the chip card mounted on/in the chip card retaining mechanism.

Referring to FIGS. 10-11, during assembly of the chip card 102 to the chip card retaining mechanism 200, firstly, the user places a finger on the plate 126 of the housing 10 and pushes the holding portion 34 away from the sidewall 124 of the housing 10. Accordingly, the sliding member 30 moves along the guide slots 26 by means of the shaft 39 until the shaft 39 reaches the ends of the guide slots 26. At the same time, the sliding member 30 is almost completely exposed to the outside, except the shaft 39.

Secondly, the holding portion 34 is pushed upward so as to force the sliding member 30 to rotate relative to the shaft 39. The sliding member 30 cannot rotate further when it pivots to a point where it is approximately perpendicular (e.g., about 80°~90°) to the upper surface 12 of the housing 10.

Thirdly, the chip card 102 is aimed at the receiving space 35 of the sliding member 30 and inserted into the receiving space 35. The latching portion 328, with the barrel 329 carried thereby, is pushed up during the insertion of the chip card 102. When the chip card 102 is completely inserted into the receiving space 35, the pressure applied on the latching portion 328 is released. Accordingly, the latching portion 328 rebounds to its original position, so that the barrel 329 prevents the chip card 102 from sliding out.

After that, the sliding member 30 is pivoted down so as to essentially be co-planar with the chip card retaining mechanism 200 and then pushed into the sliding seat 20 along the guide slots 26 until the shaft 39 reaches the respective ends of the curve sections 264 of the guide slots 26. During the insertion of the sliding member 30 into the sliding seat 20, the end of the sliding member 30 carrying the shaft 39 is supported by the sidewall of the straight sections 262, and the other end of the sliding member 30 is supported by the elastic plates 346. Therefore, the chip card 102 is kept above the main body 22, without touching the main body or the connector 104. When the shaft 39 reaches the ends of the curve sections 264, effectively lowering the shaft 39 and, concurrently, the sliding member 30, the elastic plates 346 are respectively matingly received in a corresponding receiver portion 226. This lowering of the sliding member solely during the range of length of the curve sections 264 allows the chip card 102, in the sliding member 30 to contact the connector 104 only at its "in use" position, not during assembly or disassembly.

Finally, the stopping portion 36 is pressed down, and the locking blocks 129 are engaged in the latching holes 362, respectively. Accordingly, the sliding member 30 is further depressed so as to force the chip card 102 to firmly connect with the connector 104. It should be understood that since the elastic plates 346 of the sliding member 30 are engaged in the receiver portions 226 of the sliding seat 20, the sliding member 30 is prevented from falling out of the hole 16, even if the electronic device 100 should be dropped on the floor.

The steps of removing the chip card 102 from the chip card retaining mechanism 200 are the reverse of the insertion method shown above.

It should be understood that any stress upon the chip card 102 should be equally distributed so as to avoid deformation of the chip card 102. Thus, the surface of the main body 22 for resisting the chip card 102 requires a high flatness. It also should be understood that, in reaching a same (i.e., suitably even) flatness, a flatness of a smaller area is easier to control than a larger area and, as such, cheaper to achieve. The design of the resisting portions 325 and the holes 326 may reduce the surface area of the main body 22 for resisting the chip card 102 and, accordingly, reduce the cost for manufacturing the sliding member 30.

In an alternative embodiment, the fixing portion 38 of the sliding member 30 may be omitted, and the shaft 39 may, instead, be directly fastened to the main board 32.

In another alternative embodiment, the two horizontal portions 244 of the sliding seat 20 may extend to each other so as to merge as a whole.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A chip card retaining mechanism used in an electronic device, comprising:

a sliding seat including a main body and two vertical portions extending from two opposite sides of the main body, each vertical portion defining a guide slot, the main body defining an opening configured for receiving a connector of the electronic device; and a sliding member including a main board, a stopping portion, and two holding portions, a receiving groove being formed between the main board and the two holding portions, the receiving groove being configured for receiving a chip card of the electronic device, the stopping portion extending from one end of the main board, a shaft mounted to another end of the main board, and the two respective ends of the shaft being inserted into one corresponding guide slot of the sliding seat so that the sliding member is slidably attached to the sliding seat.

2. The chip card retaining mechanism as claimed in claim 1, wherein each guide slot includes a straight section and a curve section, the straight section extends in a non-intersecting manner relative to the main body, and the curve section communicates with the end of the straight section and extends toward the main body.

3. The chip card retaining mechanism as claimed in claim 1, wherein two elastic plates are respectively formed on the holding portions, two receiver portions are respectively formed on the main body of the sliding seat, and each respective receiver portion is configured for engaging with a corresponding elastic plate.

4. The chip card retaining mechanism as claimed in claim 3, wherein each holding portion includes a vertical plate and a corresponding horizontal plate extending from the vertical plate, the vertical plate of each holding portion connects with the main board, and each respective elastic plate extends from a corresponding horizontal plate.

5. The chip card retaining mechanism as claimed in claim 4, wherein the elastic plate includes an unbent section and a vaulted section extending from one end of the unbent section, the other end of the unbent section connects with the horizontal plate, and the vaulted section is configured for receipt in the receiver portion of the sliding seat.

6. The chip card retaining mechanism as claimed in claim 1, wherein a latching portion is formed on the stopping portion end of the main board, one end of the latching portion is bent to form a barrel, and another end of the latching portion flexibly connects with the main board.

7. The chip card retaining mechanism as claimed in claim 1, wherein at least one resisting portion protrudes from one surface of the main board towards the receiving groove of the sliding member, each resisting portion being configured for resisting against the chip card.

8. The chip card retaining mechanism as claimed in claim 7, wherein two resisting portions symmetrically protrude from the main board along a centerline of the main board, the resisting portions being H-shaped.

9. The chip card retaining mechanism as claimed in claim 7, wherein each resisting portion has a hole defined at a center area thereof.

10. An electronic device, comprising:

a housing defining a battery compartment on one side and a receiving cavity on another side, a through hole being defined in the housing to communicate the battery compartment and the receiving cavity, the housing further having a connector fixed in the receiving cavity thereof; and a chip card retaining mechanism mounted in the housing, the chip card retaining mechanism including:

a sliding seat including a main body and two vertical portions extending from two opposite sides of the main body, each vertical portion defining a guide slot, the main body defining an opening configured for receiving the connector of the electronic device; and a sliding member including a main board, a stopping portion, and two holding portions, a receiving groove formed between the main board and the two holding portions, the receiving groove being configured for receiving a chip card of the electronic device, the stopping portion extending from one end of the main board, a shaft mounted on another end of the main board, and the two respective ends of the shaft being inserted into a corresponding guide slot of the sliding seat so that the sliding member is slidably attached to the sliding seat;

wherein the sliding seat is fixed in the receiving cavity and the opening of the sliding seat corresponds to the connector, and the stopping portion is received in the battery compartment so that the sliding member can move out from the receiving cavity by means of the stopping portion.

11. The electronic device as claimed in claim 10, wherein a plurality of positioning posts is formed on the bottom surface of the receiving cavity, the sliding seat defining a plurality of positioning holes configured for respectively matingly receiving the corresponding positioning posts.

12. The electronic device as claimed in claim 10, wherein a plate is formed above the through hole of the housing, two locking blocks are formed on the plate and extend toward the battery compartment, and the stopping portion defines two latching holes respectively engaging with the corresponding locking blocks.

13. The electronic device as claimed in claim 10, wherein each sliding slot includes a straight section and a curve section, the straight section extends in a non-intersecting manner relative to the main body, and the curve section communicates with the straight section and extends toward the main body.

14. The electronic device as claimed in claim 10, wherein two elastic plates are respectively formed on the holding portions, two receiver portions are formed on the main body of the sliding seat, and each respective receiver portion is configured for engaging with a corresponding elastic plate.

15. The electronic device as claimed in claim 14, wherein each holding portion includes a vertical plate and a horizontal plate extending from the vertical plate, the vertical plate of a given holding portion connects with the main board, and each respective elastic plate extends from a corresponding horizontal plate.

16. The electronic device as claimed in claim 15, wherein the elastic plate includes an unbent section and a vaulted section extending from one end of the unbent section, the other end of the unbent section connects with the horizontal plate, and the vaulted section is received in the receiver portion.

17. A chip card retaining mechanism used in an electronic device, comprising:

a sliding seat including a main body and two vertical portions extending from two opposite sides of the main body, each vertical portion defining a guide slot, the main body defining an opening configured for receiving a connector of the electronic device; and a sliding member including a stopping portion and a receiving groove configured for receiving a chip card of the electronic device, the stopping portion being positioned on one end of the sliding member, the sliding member further including a shaft mounted on another end thereof, the shaft having two respective shaft ends, each respective shaft end being inserted into a corresponding guide slot of the sliding seat so that the sliding member is slidably attached to the sliding seat.

18. The chip card retaining mechanism as claimed in claim 17, wherein each sliding slot includes a straight section and a curve section, the straight section extends relative to the main body in a non-intersecting manner, and the curve section communicates with the straight section and extends toward the main body.

19. The chip card retaining mechanism as claimed in claim 17, wherein the sliding member further comprises a main board and two holding portions respectively extending from two opposite sizes of the main board, and the main board and the two holding portions define the receiving groove.

20. The chip card retaining mechanism as claimed in claim 19, wherein at least one resisting portion protrudes from one surface of the main board towards the receiving groove of the sliding member and is configured for resisting the chip card, and the at least one resisting portion has a hole defined at a center area thereof.

* * * * *